United States Patent [19]

Polizzi et al.

[11] 4,071,968

[45] Feb. 7, 1978

[54] HEXAGONALLY SHAPED ROTATING DISPLAY WITH TETRAHEDRAL ELEMENTS

[76] Inventors: Charles J. Polizzi, 3219 Lees Ave., Long Beach, Calif. 90808; Charles R. DeCola, 10913 National Blvd., West Los Angeles, Calif. 90805

[21] Appl. No.: 711,290

[22] Filed: Aug. 3, 1976

Related U.S. Application Data

[63] Continuation of Ser. No. 359,347, May 11, 1973, abandoned, which is a continuation-in-part of Ser. No. 182,099, Sept. 20, 1971, abandoned.

[51] Int. Cl.[2] ..... G09F 11/02

[52] U.S. Cl. ..... 40/473

[58] Field of Search ..... 35/69–72, 35/77; 40/5, 33–35, 37, 61 R, 62, 75, 77.4, 77.6, 77.7, 106.3; 46/1 L; 129/16; 273/155

[56] References Cited

U.S. PATENT DOCUMENTS

| | | | |
|---|---|---|---|
| 1,997,022 | 4/1935 | Stalker | 46/1 |
| 2,688,820 | 9/1954 | Shemet | 40/37 X |
| 3,186,116 | 6/1965 | Freedman | 40/106.3 |

*Primary Examiner*—William H. Grieb
*Assistant Examiner*—Vance Y. Hum
*Attorney, Agent, or Firm*—Edwin E. Greigg

[57] ABSTRACT

An improved mobile display apparatus is provided for advertising, decorative, or other purposes, which is made up of a series of solid geometrical polygons linked to one another by hinges or universal joints, such that the movement of one polygon is transmitted to the others. The polygons may be tetrahedrons or other four-sided solid geometrical elements whose triangular sides have edges of unequal length. An even number of six or more tetrahedrons, for example, may be joined together in accordance with the invention in a continuous configuration. Odd or even numbers of three-dimensional polygons constructed from triangular elements with edges of unequal lengths may also be linked to form continuous chains, and folded together to form a display apparatus incorporating the concepts of the invention.

1 Claim, 5 Drawing Figures

HEXAGONALLY SHAPED ROTATING DISPLAY WITH TETRAHEDRAL ELEMENTS

CROSS REFERENCE TO RELATED APPLICATIONS

This application is a continuation of application Ser. No. 359,347, filed May 11, 1973, now abandoned, which is a continuation-in-part of application Ser. No. 182,099 filed on Sept. 20, 1971, now abandoned.

BACKGROUND OF THE INVENTION

Mobile display apparatus is known to the prior art, whereby different advertising messages or scenes are successively exhibited. One such apparatus, for example, takes the form of a billboard made up of a series of elongated strips, each of the strips having a triangular cross-section. The strips are mounted adjacent to one another in the prior art assembly, and they are rotatably driven in an intermittent or continuous manner, so that the different faces of the individual strips may be brought successively into a position which approximates display plane, and so that the collective faces may successively exhibit different scenes or different advertising messages in the display plane.

The mobile display apparatus of the present invention, like the mobile displays of the prior art, has particular utility in advertising, or for decorative purposes. The mobile display of the invention has an advantage in that the various solid geometric elements which make up the display are driven in an unusual and fascinating manner, so as to describe irregular paths of rotation, as each element is turned to bring a different face into the display plane. When tetrahedron elements are used, for example, and since each tetrahedron element has four faces, four separate messages may be presented on a successive basis in the display plane of apparatus constructed in accordance with the invention.

In the embodiment of the invention to be described, an improved mobile display apparatus is provided for advertising or decorative purposes, which is made up of six regular three-dimensional tetrahedron solid geometrical elements hinged together, along two opposite edges thereof. The tetrahedron elements in the embodiment to be described are supported on a bracket, and they are folded together so that one face of each element collectively forms a hexagonal display surface. Two pairs of the tetrahedron elements are rotatably mounted on the bracket, as will be described, and drive means is provided for rotatably driving pair them to cause a different set of faces of the tetrahedrons to be brought successively into the display plane. In this way four different messages or scenes may be successively displayed on the display plane as the individual tetrahedron elements turn about their respective axes.

The display apparatus of the present invention may further be adapted to unusual and unique displays, or it may be used for other purposes, such as games, gate valves, and so on. The three-dimensional solid geometrical elements, for example, may be transparent or translucent, and different objects and/or light sources may be encased within the various elements for different and unusual effects as the elements are individually rotated. As a further alternative, the sides of the individual solid geometrical elements may be indented to provide depressions therein for supporting merchandise, such as jewelry, which is to be displayed by the apparatus.

DETAILED DESCRIPTION OF THE ILLUSTRATED EMBODIMENT

Figure 4:
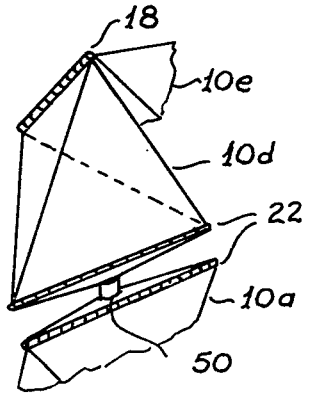
FIG. 4 is a perspective representation of a solid geometrical tetrahedron element, six of which are used in the display of FIGS. 1–3.
Figure 5:
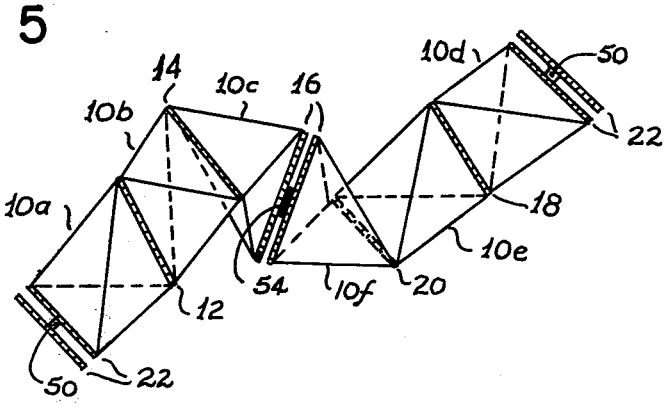
FIG. 5 is a developed perspective representation of the six tetrahedron elements used in the display of FIGS. 1–3, and illustrating the manner in which the elements are hinged to one another.

In the practice of the illustrated embodiment of the present invention, six solid geometric tetrahedron elements, such as the tetrahedron element 10 of FIG. 4, are hinged together in the illustrated manner of FIG. 5; the elements in FIG. 5 being designated 10*a*, 10*b*, 10*c*, 10*d*, 10 *e* and 10*f*. The elements 10*a* and 10*b* are hinged together, for example, by means of hinge 12, the elements 10*b* and 10*c* are hinged by means of a hinge 14, the elements 10*c* and 10*f* are hinged together by a pair of hinges 16, the elements 10*d* and 10*e* are hinged together by a hinge 18, the elements 10*e* and 10*f* are hinged by a hinge 20 and the elements 10*a* and 10*d* are coupled together by a pair of hinges 22 in the manner that will be subsequently explained. It will be observed in the representation of FIG. 5 that the various hinges 12, 14, 16, 18, 20 and 22 are formed along two edges of each of the respective elements.

Figure 1:
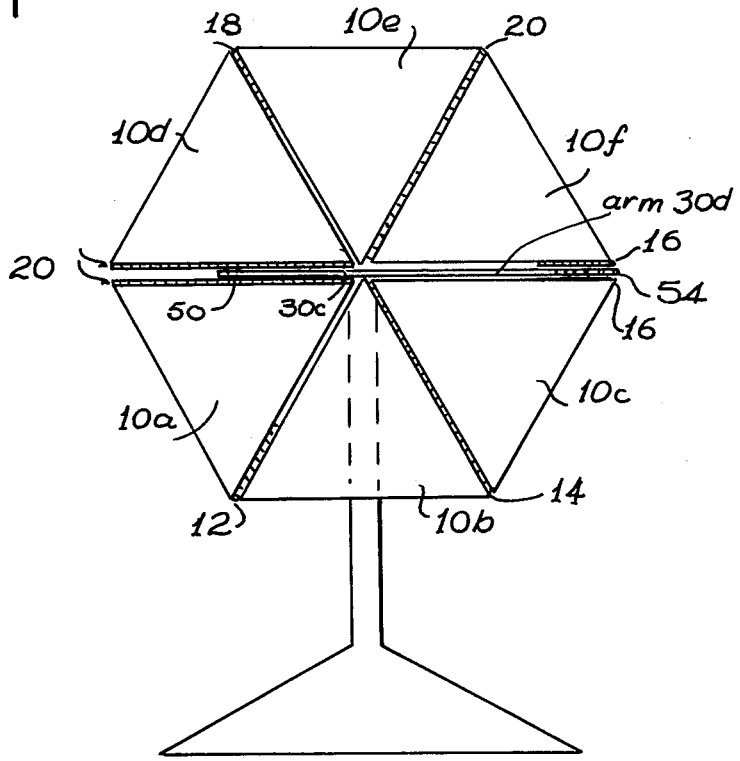
FIG. 1 is a front elevational view of a display apparatus constructed in accordance with one embodiment of the invention.
Figure 2:
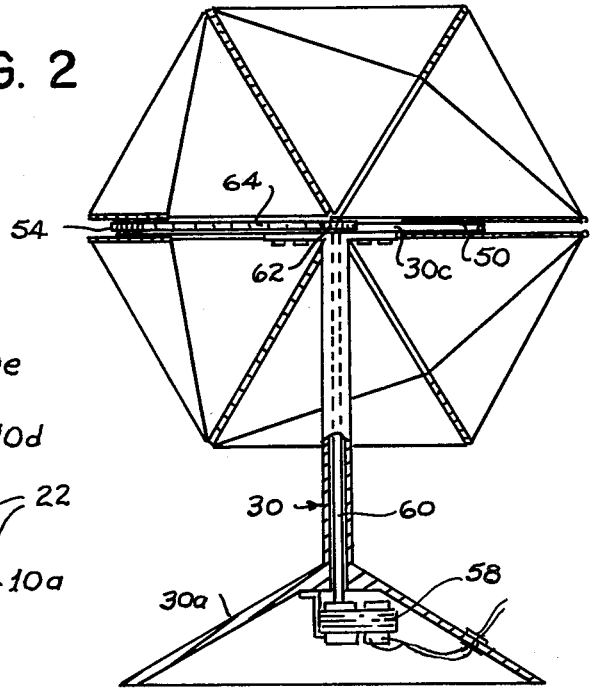
FIG. 2 is a back view of the display of FIG. 1.
Figure 3:
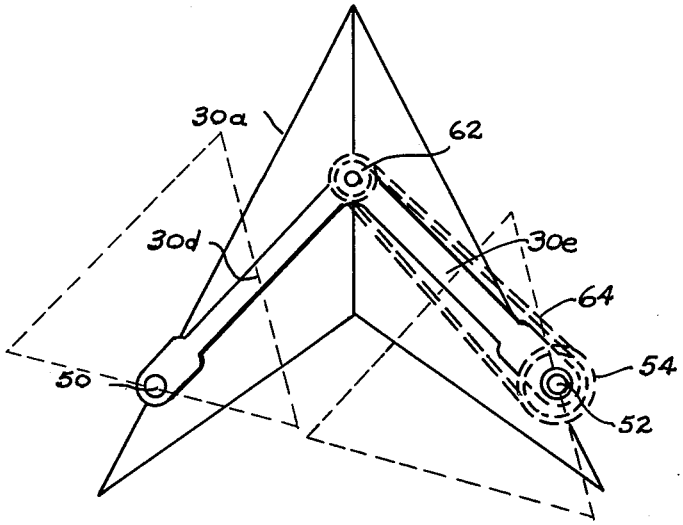
FIG. 3 is a top plan view of the display of FIG. 1.

In the practice of the invention, the tetrahedron elements of FIG. 5 are folded together as shown in FIGS. 1, 2 and 3, and mounted on a support bracket 30. The support bracket 30 comprises a base 30*a*, an upright elongated tubular post member 30*b*, and two arms 30*c* and 30*d* at the upper end of the post member. The tetrahedron elements, as shown in FIG. 1, for example, are folded together so that the elements 10*d*, 10*e* and 10*f* may form the upper half of the display, and the elements 10*a*, 10*b* and 10*c* may form the lower half of the display.

The elements 10*a* and 10*d* are rotatably mounted on the arm 30*c* by means, for example, of a shaft 50 each end of which is connected to one of the pair of hinges 22. The elements 10*f* and 10*c* are pivotally mounted on the arm 30*d* by means, for example, of a shaft 52. The shaft 52 supports a drive sprocket 54 and each end of shaft 52 is connected to one of the pair of hinges 16, so that when the drive sprocket 54 is rotated, the elements 10*f* and 10*c* are caused to rotate about the axis of the shaft 52. It will be observed that the shaft 50 and shaft 52 are located on axes which are parallel to one another and spaced from one another by a fixed distance by arms 30*c* and 30*d*, as best shown in FIG. 3.

A motor 58 is mounted on the base 30*a* in the illustrated embodiment, and the motor drives an inner drive shaft 60 which extends up the tubular member 30*b*, and which is keyed to a sprocket 62 at the top of the tubular member 30*b*. A chain 64 couples the sprocket 62 to the sprocket 54, so that when the motor 58 is energized, the sprocket 54 is driven to rotate the tetrahedron elements 10*f* and 10*c*.

The hinged relationship between the aforesaid tetrahedron elements, and the mounting of the elements on the bracket by the shafts 50 and 52 is such, that when the elements 10*f* and 10*c* are rotatably driven by the motor 58, they drive the other tetrahedron elements and cause them to turn. The relationship is such that, as each of the tetrahedron elements turns, a different face of the individual elements is brought into the hexagonal display plane of FIG. 1. As mentioned above, a different scene, or different advertising message may be inscribed on the various faces of the individual tetrahedron elements, so that as the mobile display of the invention is activated, different scenes are successively presented at the display plane.

In addition to the provision of different scenes on the difference faces of the individual tetrahedron elements, the display of the invention has an attractive effect as it changes from one surface to another, since it simulates, for example, the blossoming of a rose, or similar flower. This occurs as the individual tetrahedron elements turn to cause the center of the display to move outwardly and around, and to cause the next successive faces of the individual tetrahedron elements to move into position.

It will be observed, therefore, that in the embodiment described above, and illustrated in the drawings, the solid geometrical tetrahedron elements may be supported by mounting a first bearing on the bracket at the center of the hinge between two of the tetrahedron elements, and by mounting another bearing on the bracket 30 displaced 180° from the first bearing, as described. With other configurations of the individual solid geometrical elements, it will be necessary to use more than two bearings, and to permit one or more of the bearings to move in space with respect to the others. The resulting assembly provides a complicated and interesting pattern of movement. However, the elements themselves must be shaped to allow for this extra movement. For example, the solid geometrical polygon elements incorporated into the latter type of apparatus would be relatively tall and narrow, as compared with the elements illustrated herein. In the illustrated embodiment, the triangular faces of the tetrahedron elements closely approximate equilateral triangles. Specifically, the triangular faces of the elements each has a height equal to its base width.

In the embodiment illustrated herein, the display is powered by the motor 58 mounted on the support bracket 30, with power being transmitted to the elements by means of the chain 64. It is obvious that the motor could be mounted at different places on the support bracket, and that power could be transmitted to the solid geometric elements by means of a belt, gear, shaft, ratchet, pneumatic or hydraulic drive, or the like, or some combination of the foregoing. Moreover, the motor 58 may be mounted inside one of the solid geometrical polygon elements, and be free to move from side to side as the particular geometrical element moves. In such a case, a flexible shaft and/or universal joint would be required to connect the motor to the supporting framework. The output shaft of the motor would then be connected internally to the particular element, so that the element would turn about the motor. It would also be possible to spin the motor with the particular polygon element, but slip rings or some other means would then be required to transmit electrical power to the motor.

In the embodiment described herein, the device is mounted vertically, as shown in the accompanying drawing. However, the elements may be mounted in a horizontal relationship with an advantage in that the resulting surface would provide a 360° viewing angle for the scene or advertising message printed thereon.

The invention provides, therefore, an improved, unique and attractive display apparatus for advertising or other purposes. The apparatus of the invention is especially advantageous in that the unique and irregular movements of the individual solid geometrical elements, as their individual faces are successively brought into the display plane, are complex and unusual, and serve as a positive means for attracting the attention of the casual observer.

While particular embodiments of the invention have been shown and described modifications may be made, and it is intended in the following claims to cover all modifications which come within the spirit and scope of the invention.

What is claimed is:

1. A mobile substantially hexagonal display comprising, in combination:

a) two groups of three tetrahedran elements each, the faces of each element having substantially the shape of an isosceles triangle, the elements in each group being flexibly hinged together along opposite edges thereof, and the free edges of the outer elements of each group which are substantially at right angles to the hinged edge of their respective element, including at the center thereof, a further hinge defining and rotation receiving means;

b) a supporting bracket having two stationary, spaced apart, arms each with a free end, said arms lying in a common plane and directly engaging, at their free end, the two groups of elements for supporting the elements for relative motion;

c) the six elements presenting, during the course of their relative motion, a changing substantially hexagonal shaped and substantially continuous display surface collectively formed by one face of each of the elements, with adjacent faces of corresponding outer elements in each group lying in a plane each substantially parallel to said common plane when the substantially continuous display surface is formed;

d) pivot means mounted at the free end of each arm, said pivot means being engageable with the further hinge defining and rotation receiving means of the outer elements of each group for effecting thereby the engagement of the arms to the two groups of elements; and e) drive means engaging the pivot means on one arm for imparting to said pivot means a rotation which is transmitted by said pivot means and through the corresponding further hinge defining and rotation receiving means to one outer element of each group, with the rotation being transmitted by these outer elements to the other elements in each group and to the other pivot means through the further hinge defining and rotation receiving means of the other outer elements, whereby the visible faces of said elements are collectively changed to form said substantially hexagon shaped and substantially continuous display surface.

* * * * *